US008181919B1

(12) United States Patent
Blum

(10) Patent No.: US 8,181,919 B1
(45) Date of Patent: May 22, 2012

(54) FILM BAG HOLDER

(76) Inventor: Alvin S. Blum, Fort Lauderdale, FL (US)

( * ) Notice: Subject to any disclaimer, the term of this patent is extended or adjusted under 35 U.S.C. 154(b) by 0 days.

(21) Appl. No.: 12/655,393

(22) Filed: Dec. 30, 2009

(51) Int. Cl.
*A63B 55/04* (2006.01)

(52) U.S. Cl. ..... 248/97; 248/95; 220/495.08

(58) Field of Classification Search ..... 220/495.06, 220/495.08, 495.01, 908, 908.1, 495.11, 220/483, 480, 694; 248/95, 97, 99, 101, 248/907, 683, 206.5, 309.4
See application file for complete search history.

(56) References Cited

U.S. PATENT DOCUMENTS

| | | | | |
|---|---|---|---|---|
| 2,283,069 | A | 5/1942 | Knuetter | |
| 2,964,275 | A * | 12/1960 | Atkinson | 248/95 |
| 3,773,286 | A * | 11/1973 | Govoni et al. | 248/97 |
| 4,139,037 | A | 2/1979 | McGuigan | |
| 5,518,136 | A * | 5/1996 | Muldner et al. | 220/495.11 |
| 6,109,002 | A | 8/2000 | McCabe | |
| 6,290,392 | B1 | 9/2001 | Sandor | |
| 6,393,804 | B1 | 5/2002 | Ausnit | |
| 6,698,474 | B1 | 3/2004 | Trsek | |
| 6,866,070 | B2 | 3/2005 | King | |
| 7,077,364 | B2 | 7/2006 | Hendzel | |
| 7,137,736 | B2 | 11/2006 | Pawloski | |
| 7,246,641 | B2 | 7/2007 | Blessman | |
| 7,364,361 | B2 | 4/2008 | Turvey | |
| 7,410,298 | B2 | 8/2008 | Pawloski | |
| 7,490,718 | B2 * | 2/2009 | Shen | 206/6.1 |
| 7,578,409 | B1 * | 8/2009 | Kulasik | 220/495.04 |
| 2005/0157957 | A1 | 7/2005 | Turvey | |
| 2009/0232421 | A1 | 9/2009 | Turvey | |

OTHER PUBLICATIONS

Sakurai, Support instrument for storage bag has pinch sto portion of bag fixing permanent magnet or magnetic material piece to detach/attach corresponding to magnetic material piece or permanent magnet provided in pillar, Japan Patent Publication under Derwent, Dec. 6, 2007.*

* cited by examiner

*Primary Examiner* — A. Joseph Wujciak, III
(74) *Attorney, Agent, or Firm* — Alvin S. Blum

(57) ABSTRACT

The apparatus holds open the mouth of a plastic film bag, while holding it upright for filling. It is readily applied and removed after the filling has been done. It is easily cleaned. The holder has a convenient footprint for storage beneath the bag package when in a storage mode. The holder has arms that engage a surface of the bag proximate the bag opening and leg members that engage the other surface of the bag. The arms are removably attached to the leg members with the bag film sandwiched in between them by magnetic force. The combination of spaced-apart arms and spaced-apart leg members together hold the bag open and upright for filling.

2 Claims, 3 Drawing Sheets

FIG. 15
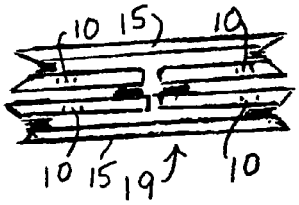
FIG. 11
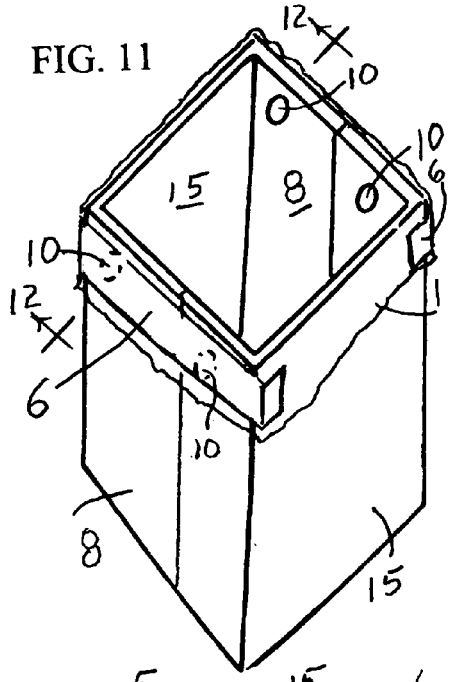
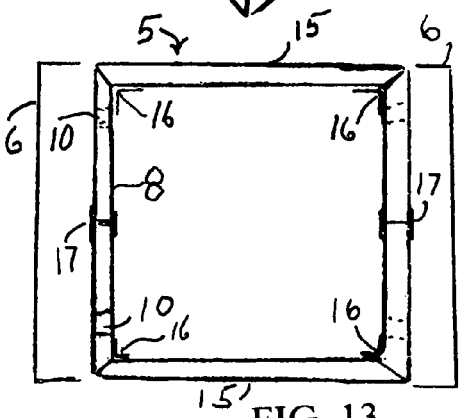
FIG. 13
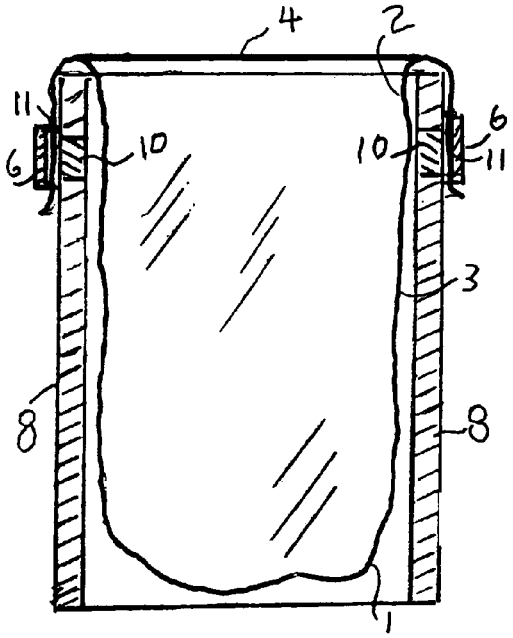
FIG. 12
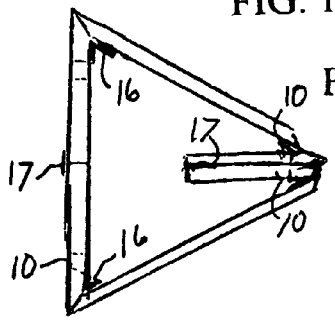
FIG. 14

FILM BAG HOLDER

FIELD OF THE INVENTION

This invention relates generally to film bags, and more particularly to apparatus removably applied to the bag to hold it open and upright during filling.

BACKGROUND OF THE INVENTION

Plastic film bags with or without zipper like interacting male and female elements that enable the mouth to be sealed and reopened repeatedly are well known in the art. Filling the bags may be awkward because the bags are so flaccid that they must be held open. Various patents disclose elements incorporated into the bags to hold them open. These elements do not hold the open bag upright, and they are only needed during the moments when the bag is being filled, but increase the cost of every bag. It would be useful to have a hold open device that is applied to the bag only during filling, and that holds the bag open and upright despite the flaccid nature of the bag.

SUMMARY OF THE INVENTION

It is accordingly an object of the invention to provide a device that will hold open the mouth of a plastic film bag, while holding it upright for filling. It is another object that the device be readily applied and removed after the filling has been done. It is another object that it be easily cleaned. It is yet another object that the device have a convenient footprint for storage beneath the bag package. The holder of the invention has arms that engage a surface of the bag proximate the bag opening and leg members that engage another surface of the bag. The arms are removably attached to the leg members with the bag film sandwiched in between them by magnetic means. The combination of spaced-apart arms and spaced-apart leg members together hold the bag open and upright for filling These and other objects, features, and advantages of the invention will become more apparent from the detailed description of an exemplary embodiment thereof as illustrated in the accompanying drawings, in which like elements are designated by like reference characters in the various drawing figures.

BRIEF DESCRIPTION OF THE DRAWINGS

FIG. 11 is a perspective view of the apparatus of FIG. 10 in use.

FIG. 12 is a sectional view through line 12-12 of FIG. 11.

FIG. 13 is top view of the apparatus of FIG. 10.

FIG. 14 is a partially folded frame of FIG. 10.

FIG. 15 is a folded frame of FIG. 10.

DETAILED DESCRIPTION OF PREFERRED EMBODIMENTS

Figure 1:
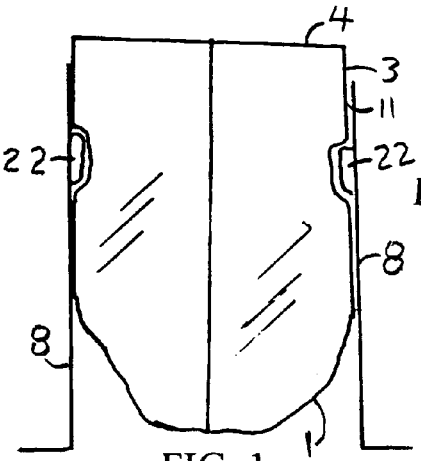
FIG. 1 is a front elevation of the apparatus in use.
Figure 10:
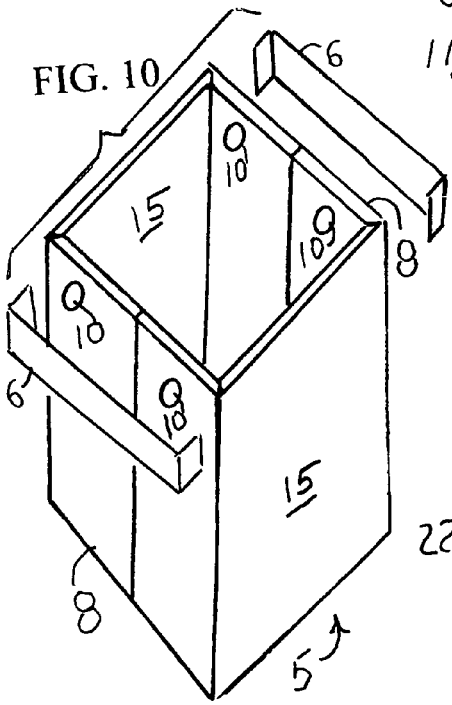
FIG. 10 is a perspective view of another embodiment of the invention.
Figure 9:
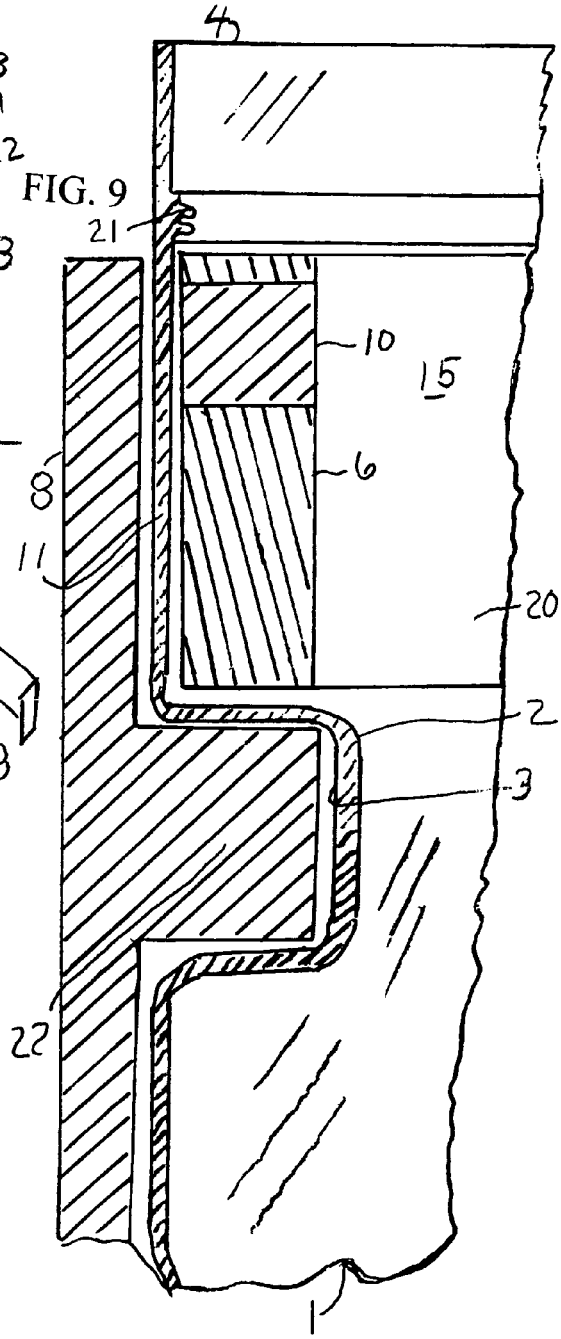
FIG. 9 is a sectional detail view through line 9-9 of FIG. 2.
Figure 7:
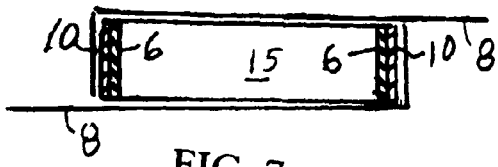
FIG. 7 is a sectional view through line 7-7 of FIG. 6.
Figure 5:
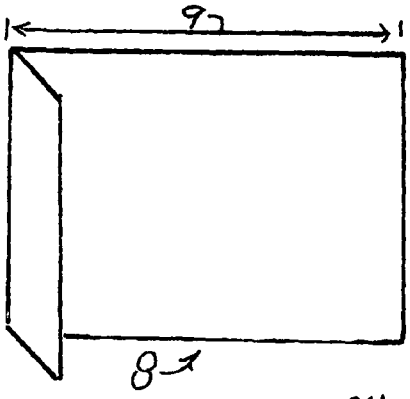
FIG. 5 is a perspective view of a leg member of the invention.
Figure 3:
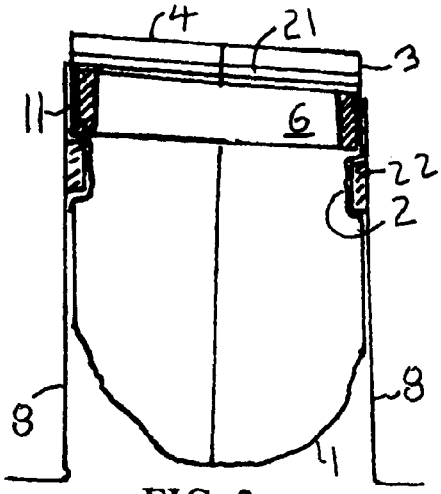
FIG. 3 is a sectional view through line 3-3 of FIG. 2.
Figure 4:
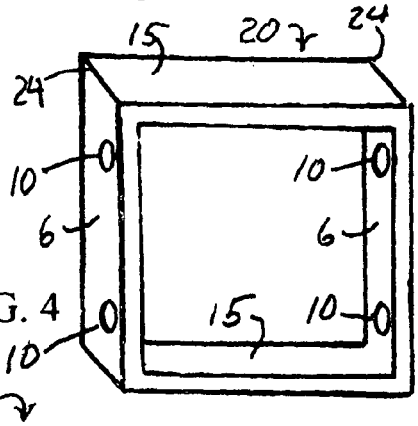
FIG. 4 is a perspective view of a rigid frame of the invention.
Figure 2:
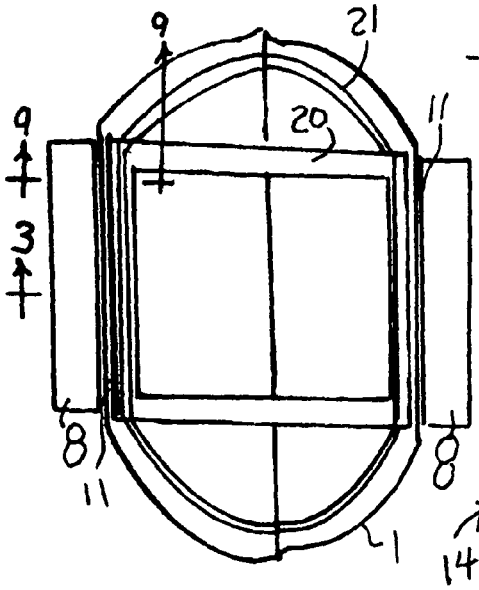
FIG. 2 is a top view of the apparatus in use.
Figure 6:
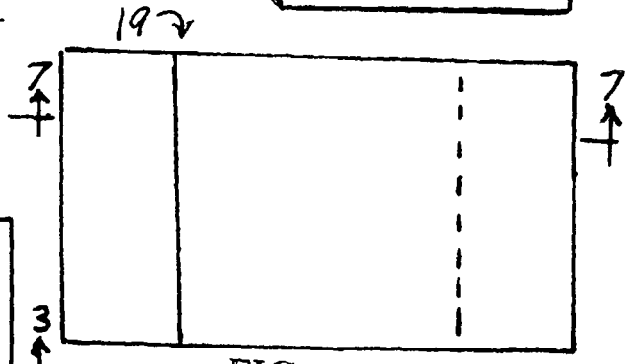
FIG. 6 is a top view of the apparatus in storage mode.
Figure 8:
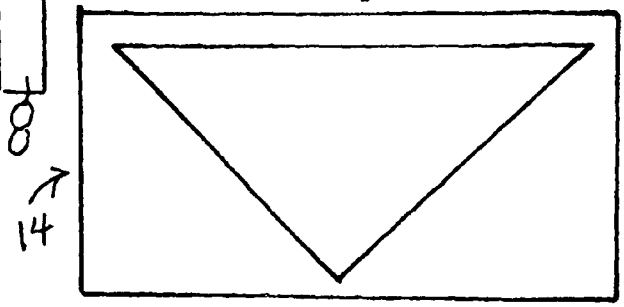
FIG. 8 is a top view of a container that holds a supply of bags.

Plastic film storage bags are an economical and convenient means of storing foodstuffs and other items. They have closed sides and bottom and an open end or mouth. They may be used once and discarded at little cost. Some have one or more securement strips proximate their open end. Others rely upon external ties for closure. Referring now first to the drawing FIGS. 1-9, apparatus 5 is provided to hold a plastic film storage bag 1 open and upright so that it can be easily filled. Two rigid spreader arms 6 are adapted to hold the mouth 4 of the bag open when they are in opposed, spaced-apart relationship by engaging the inner surface 2 of the bag proximate the open end 4. A pair of elongate connectors 15 affixed to the ends 24 of the arms hold the arms in spaced-apart relation to form an open frame 20 through which items can be loaded into the bag. Two elongate leg members 8, each having a length 9 to hold the bag upright are held against the outer surface of the bag in spaced-apart relation by magnetic force attaching each leg member 8 to an arm 6 with a bag film held sandwiched between them. Permanent magnets 10 are affixed to the arms, and the leg members are provided with ferromagnetic material to cause them to be attached to one another to thereby hold the bag open and upright for filling. In an alternative embodiment, not shown, the magnets may be on the leg members and the arms may be provided with ferromagnetic material. The bag 1 shown here has securement strip 21. The frame 20 fits under the strip and engages it so that the bag will not easily slip through the grasp of the arm and leg member. The leg member may optionally be provided with projections 22 to further enhance the grasp. The apparatus is easily removed after filling the bag. Only the frame 20 may need cleaning after use. The apparatus is converted from the operational configuration to the folded flat configuration shown in FIGS. 6 and 7. This can be dimensioned so that it has a footprint equal or less than that of the container 14 of the bags, for convenient storage under the container, where it is always handy for use, while not occupying additional storage space. The magnets 10 hold the legs against the frame 20 with the film of the bag firmly sandwiched tightly therebetween, although the drawings show some space for illustrative purposes.

Referring now to the drawing FIGS. 10-15, another embodiment of the invention is shown that, once again, employs the concept of a magnetic attraction between spreader arms and leg members to tightly hold the bag plastic in a condition in which the bag mouth is held open and up high enough to facilitate loading material into the bag. The two leg members 8 are held in spaced-apart relationship by a pair of connecting walls 15 to form a tubular configuration in an operating mode. Permanent magnets 10 in the leg members attract the ferromagnetic spreader arms (e.g. stainless steel) to hold open the mouth of the bag by clamping bag plastic between them proximate the open mouth 4. As shown, the arms 6 are dimensioned to snugly engage the outside surface of the leg members. The bag is inserted into the tubular cavity formed by the leg members 8 and the walls 15. The top of the bag is the folded over the top of the tube so that the inner surface 2 of the bag can be engaged by each arm 6 and the outer surface 3 of the bag is engaged by the leg members to hold the bag mouth open and elevated above a support surface enough to facilitate bag filling. Alternatively, the arms may be dimensioned to fit snugly within the tube (not shown). In that case, the arms will engage the inner surface 2 of the bag, and the leg members will engage the outer surface 3 of the bag.

In order to make this embodiment foldable into a flat storage mode that will fit under a package of bags in the same footprint, each leg member is divided in half, with a hinge 17 joining the two halves. And each wall 15 is hingedly joined to the two leg members by hinges 16. An economical construction method is to extrude a polyolefin tube with the parts joined by living hinges that is then cut to length and holes cut to receive the magnets. When the legs are folded, the two magnets on each leg are brought together as shown in FIGS. 14 and 15. The magnets should be mounted so that their polarities are opposite. This will facilitate maintaining the folded condition.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. Apparatus to hold open and upright a plastic film storage bag, the apparatus comprising: the storage bag having an inner surface, an outer surface, and an open top;

two rigid spreader arms to hold open the top for depositing material into the bag, the spreader arms adapted to engage the inner surface in opposed, spaced-apart relationship;

two elongate leg members adapted to engage the outer surface in opposed spaced-apart relationship and having a length dimensioned to hold the open bag upright for loading; and magnet means affixed to either one of each arm or of each leg member for removably attaching, by magnetic force, each arm to a leg member with bag film sandwiched therebetween to thereby hold the arms and leg members in spaced apart relationship and to hold the bag with top open and upright for loading;

the leg members and spreader arms having a flat storage configuration with a flat storage configuration that does not exceed that of a container of said bag; and in which the bag has a securement strip on the inner surface adjacent the open mouth, and the spreader arms are adapted to engage the inner surface below the securement strip to prevent the held bag from sliding downward.

2. The apparatus of claim 1 further comprising a projection affixed to each leg member, the projection adapted to engage the arm through the bag film when the arm is engaging the securement strip.

* * * * *